US008373118B2

(12) United States Patent
Prosser et al.

(10) Patent No.: US 8,373,118 B2
(45) Date of Patent: Feb. 12, 2013

(54) ATMOSPHERIC PRESSURE IONIZATION INLET FOR MASS SPECTROMETERS

(75) Inventors: Simon Prosser, Ithaca, NY (US); Jack Henion, Ithaca, NY (US); Stephen Thompson, Old Trafford (GB); Vic Parr, Old Trafford (GB)

(73) Assignees: Advion, Inc., Ithaca, NY (US); Scientific Analysis Instruments Ltd., Manchester (GB)

( * ) Notice: Subject to any disclaimer, the term of this patent is extended or adjusted under 35 U.S.C. 154(b) by 0 days.

(21) Appl. No.: 13/212,259

(22) Filed: Aug. 18, 2011

(65) Prior Publication Data

US 2012/0097845 A1 Apr. 26, 2012

Related U.S. Application Data

(60) Provisional application No. 61/405,424, filed on Oct. 21, 2010.

(51) Int. Cl.
*H01J 49/26* (2006.01)
*H01J 49/00* (2006.01)

(52) U.S. Cl. ..... 250/288; 250/281; 250/282; 250/289

(58) Field of Classification Search ..... 250/281, 250/282, 288, 289, 290–294, 298
See application file for complete search history.

(56) References Cited

U.S. PATENT DOCUMENTS 4,730,111 A * 3/1988 Vestal et al. ..... 250/288
6,087,657 A * 7/2000 Kato ..... 250/288
6,462,336 B1 * 10/2002 Bajic ..... 250/288
6,992,283 B2 * 1/2006 Bateman et al. ..... 250/287
7,091,477 B2 8/2006 Jolliffe et al.
7,405,398 B2 7/2008 Jolliffe et al.
2003/0183759 A1 * 10/2003 Schwartz et al. ..... 250/292
2004/0211897 A1 * 10/2004 Kim et al. ..... 250/288
2004/0262512 A1 12/2004 Tobita et al.
2005/0035287 A1 2/2005 Jolliffe et al.
2009/0134321 A1 * 5/2009 Hoyes ..... 250/282

OTHER PUBLICATIONS

Authorized officer Lana Osafo-Gyimah, International Search Report/Written Opinion in PCT/US2011/048181 mailed Apr. 5, 2012, 15 pages.

Olivares and Houk, "Ion Sampling for Inductively Coupled Plasma Mass Spectrometry," Analytical Chemistry 57(13):2674-2679 (1985).

van der Hoeven et al., "Performance of an electrospray-interfaced thermospray ion source in hyphenated techniques", Journal of Chromatography A, 712:211-218 (1995).

Covey, "The API 5000 and Other Bioanalytical Initiatives", API 5000 Launch Presentation_TC_March 10, 2005.ppt (2005) 21 pages.

Covey et al., "Atmospheric Pressure Ion Sources", Mass Spectrometry Reviews, 00:1-29 (2009).

Fenn, "Mass spectrometric implications of high-pressure ion sources", International Journal of Mass Spectrometry 200:459-478 (2000).

* cited by examiner

*Primary Examiner* — Bernard E Souw

(74) *Attorney, Agent, or Firm* — Fish & Richardson P.C.

(57) ABSTRACT

Methods and systems for mass spectrometry and more particularly to an interface providing charged particles to a mass spectrometer are described herein.

21 Claims, 8 Drawing Sheets

ATMOSPHERIC PRESSURE IONIZATION INLET FOR MASS SPECTROMETERS

CROSS-REFERENCE TO RELATED APPLICATIONS

This application claims the benefit under 35 U.S.C. §119 (e) of U.S. Application Ser. No. 61/405,424, filed on Oct. 21, 2010, which is incorporated by referenced herein in its entirety.

FIELD OF THE INVENTION

Methods and systems for mass spectrometry and more particularly to an interface providing charged particles to a mass spectrometer are described herein.

BACKGROUND OF THE INVENTION

Mass spectrometry is an analytical process for obtaining the molecular weight, chemical composition and structural information of a compound or sample based on the mass-to-charge ratio of charged particles. In general, in mass spectrometry, a sample undergoes ionization to form charged particles as ions; these charged particles are then passed through electric and/or magnetic fields to separate them according to their mass-to-charge ratio. The separated ions are then measured at a detector.

Mass spectrometers generally need to be operated at high vacuum (e.g., $10^{-4}$ to $10^{-6}$ Torr) to limit the interactions between ions and gas molecules within the mass spectrometer which would otherwise degrade performance. One challenge in mass spectrometry is providing an efficient method of getting representative ions from the sample into such a mass spectrometer vacuum system. In some mass spectrometry systems, the ionization process occurs within the vacuum envelope, but this limits the types of samples that can be analyzed to gas phase samples and solid samples that exhibit low vapor pressure.

Atmospheric Pressure Ionization (API) ion sources have become increasingly important as they have greatly increased the types of samples that can be measured by mass spectrometers. These sources form the ions at, or about, atmospheric pressure, outside the mass spectrometer and the ions and charged particles are transferred to the high vacuum region of the mass spectrometer through the Atmospheric Pressure Ionization (API) interface that generally includes a small ion inlet orifice or capillary and a transfer region that may contain a number of electric fields and intermediate vacuum stages to manipulate the charged particles and successively reduce the pressure.

This has allowed mass spectrometers to be interfaced to a large number of ionization techniques increasing the types of samples that can be measured, whether in gas, solid, or even liquid form. Exemplary ion sources include, but are not limited to, Electrospray Ionization (ESI), Atmospheric Chemical Ionization (APCI), Atmospheric Pressure Photo Ionization (APPI), Matrix Assisted Laser Ionization, (MALDI), Direct Analysis in Real Time (DART) and Desorption Electrospray Ionization (DESI). These ion sources have allowed mass spectrometers to be coupled to widely used tools such as High Performance Liquid Chromatography.

Ion sources such as ESI and APCI provide charged particles from liquid solutions of sample and solvent. The solution, including the molecules of interest, is pumped through an orifice or a capillary and an electric potential is either placed on the capillary (ESI) or a needle close to the mass analyzer. Coaxial nebulization gas may assist the formation of a plume of highly charged droplets from the capillary at atmospheric pressure. Since the ionization occurs directly from solution at atmospheric pressure, the ions formed in this process can sometimes be strongly solvated. Prior to measurement, the solvent molecules associated with the ions are removed. So the API interface performs many functions; it desolvates the charged droplets to form gas phase ions, it transfers these ions into the mass spectrometer analyzer maintained at high vacuum and removes the great majority of the air, gas and solvent molecules that enter the API interface with the ions.

The efficiency with which the API interface performs these functions determines the overall sensitivity of the system and other performance factors. In many API interfaces the pressure is reduced from atmosphere to high vacuum in one or more intermediate vacuum stages. With conventional API interfaces the number of ions that are sampled, and hence the sensitivity, are limited by the size of the apertures between the various stages. The larger the apertures the greater the sensitivity, but the larger and more expensive the vacuum pumps required to maintain the intermediate stages at the required pressure.

Increasing the gas flow into the mass spectrometer also increases the problems of contamination as more of the solvent and surrounding environment is admitted to the API interface. Many conventional mass spectrometers have direct line-of-sight through the system so that contamination that enters the API interface can end up in the analyzer and detector regions, degrading their performance and which is difficult and time consuming.

SUMMARY

Methods and systems for mass spectrometry and more particularly to an interface providing charged particles to a mass spectrometer are described herein.

In some aspects, systems described herein include an Atmospheric Pressure Interface that is believed to provide the advantage of ensuring high sensitivity across a wide mass range whilst reducing the pumping requirements and amount of contamination entering the mass spectrometer analyzer.

In some examples, systems and methods described herein collect the charged particles in a turbulent region of the ion sampling region downstream from the capillary exit as opposed to collecting the charged particles in an initial quiet zone adjacent to the capillary or in a region exhibiting laminar flow.

In some examples, the extracting aperture is located opposite or nearly opposite the region in the flow path wherein the Mach disk or turbulent region is formed (e.g., at a position in the gas flow path where the ions encounter a Mach disk or turbulent flow region). As such, the ions are collected from a region in which the ions undergo turbulent flow. In this region the gas flow velocity is significantly reduced compared to the laminar flow region. It is believed that collecting ions (and in particular large mass bio-molecules) in this region is more efficient and can lessen the need for excessive extraction fields.

In some aspects, an atmospheric pressure ion source for providing ions to a mass spectrometer system includes a capillary having a first opening, a second opening, and passage extending from the first opening to the second opening, the first opening being in a first pressure region at about atmospheric pressure and the second opening being in the second pressure region at a partial vacuum of about 3 Torr or less, the capillary being positioned so that during operation of the mass spectrometry system ions enter the passage via the first opening and exit the passage via the second opening. The system also includes a vacuum chamber defining the second pressure region and having an inlet configured to receive ions from the second opening of the capillary, the vacuum chamber including an extracting aperture positioned so that during operation of the mass spectrometry system ions enter a third pressure region at about $10^{-2}$ Torr or less via the extracting aperture at a location of a turbulent region in the gas flow.

Embodiments can include one or more of the following.

The turbulent region can be a region exhibiting a Mach disk in the gas flow.

The extraction orifice can be located at a location determined based at least in part on a calculation of $\frac{2}{3}(P0/P1)^{1/2}$ where P0 and P1 are the pressures of the first and second pressure regions respectively.

The extracting aperture can be at a location subsequent to a quiet zone in the gas flow in the vacuum chamber.

The extracting aperture can be at a location subsequent to a quiet zone and at least one region of laminar flow in the gas flow in the vacuum chamber.

The vacuum chamber can be configured such that during operation of the mass spectrometry system alternating regions of laminar flow and turbulent flow are produced in the gas flow.

The member can be configured such that during operation of the mass spectrometry system alternating regions of laminar flow and turbulent flow are produced in the gas flow and the extracting aperture is at a location associated a first region of turbulent flow.

The capillary can have a diameter less than about 1 mm and length greater than 5 cm.

The source can further include a voltage source connected to the aperture configured to produce a substantially orthogonal extracting field perpendicular to the gas flow in the second pressure region.

The capillary can have a diameter of from about 300 μm to about 1000 μm and the vacuum chamber can have a diameter of from about 5 mm to about 20 mm.

The capillary can have a diameter of from about 50 μm to about 300 μm and the vacuum chamber can have a diameter of from about 2 mm to about 10 mm.

The capillary can have a diameter of from about 700 μm to about 2000 μm and the vacuum chamber can have a diameter of from about 15 mm to about 50 mm.

The system can also include a quadrupole mass analyzer positioned in the third vacuum region.

The capillary can be configured to form a region of laminar flow near the second opening of the capillary.

The system can also include a pump configured to form the partial vacuum in the second pressure region and the vacuum in the third pressure region.

The first opening of the capillary can be oriented in a direction that is 90 degrees from a direction of the extraction orifice.

The first opening of the capillary can be oriented in a direction that is the same as the direction of the extraction orifice but offset from the extraction orifice.

The system can also include an electrospray ion source configured to produce an electrospray near the first opening of the capillary.

The capillary can be a heated capillary.

The system can also include a pusher plate opposite the extraction orifice in the member.

DESCRIPTION

Figure 1:
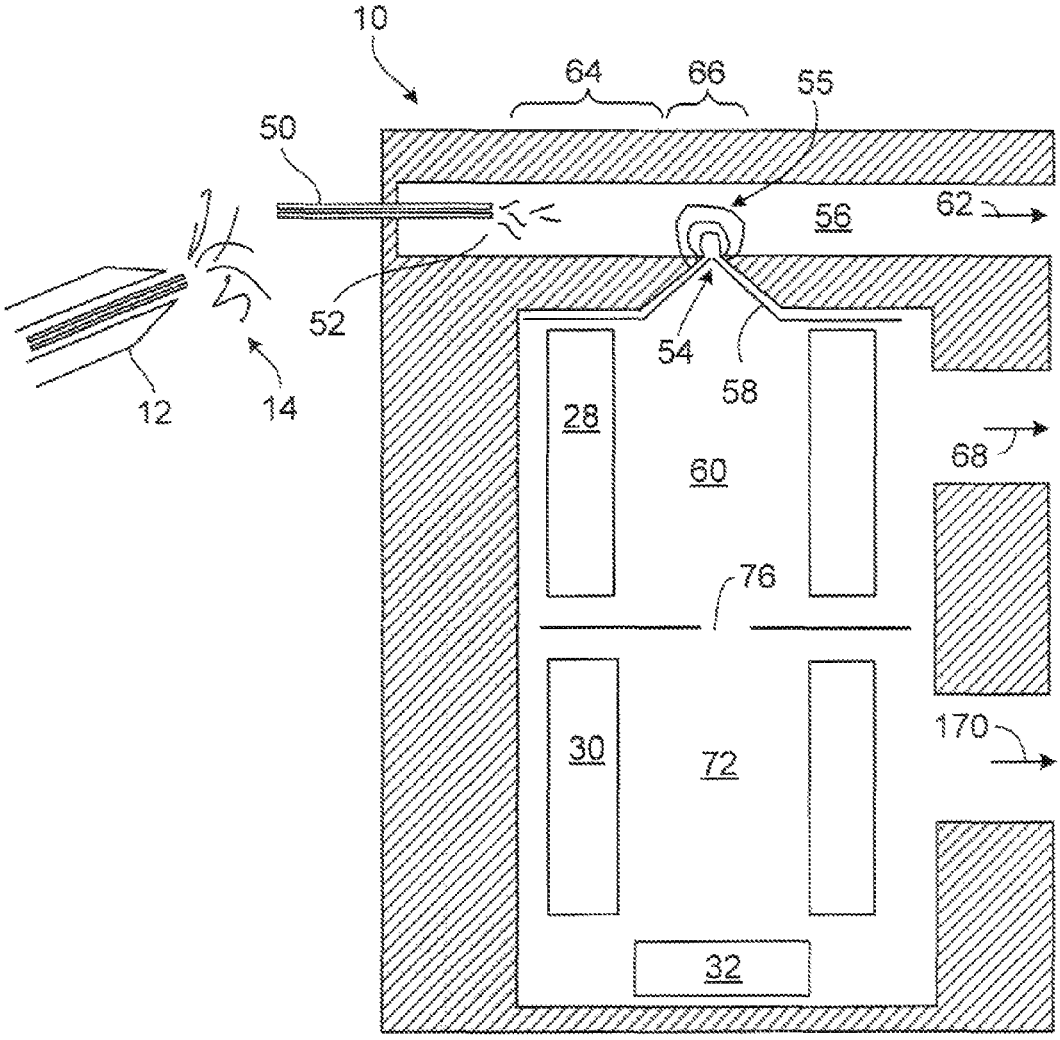
FIG. 1 shows a schematic representation of a mass spectrometry system.

FIG. 1 is a schematic representation of a mass spectrometry system 10. Mass spectrometry system 10 is used to identify the chemical composition of a compound or sample based on the mass-to-charge ratio of charged particles.

As described in more detail below, during use, an ion source, in this case an electrospray ion source 12, generates a spray 14 of charged droplets and particles that includes the ions of interest at, or about, atmospheric pressure. Examples of atmospheric pressure ion sources may include Electrospray Ionization (ESI), Atmospheric Chemical Ionization (APCI), Atmospheric Pressure Photo Ionization (APPI), Matrix Assisted Laser Ionization, (MALDI), Direct Analysis in Real Time (DART) and Desorption Electrospray Ionization (DESI) and many others. The atmospheric pressure ion source may also include chip-based and microfabricated spraying devices.

The electrospray droplets from spray 14 enter into the ion entrance (such as an entrance to a heated capillary 50) of an API interface that directs the ions from the electrospray 14 through the capillary 50 to an outlet of the capillary 52 and into a vacuum chamber 56. The vacuum chamber 56 is held at a first intermediate vacuum between about 1 and about 10 Torr (e.g., from about 1 to about 8 Torr, from about 1 to about 5 Torr, from about 1 to about 3 Torr). As the droplets from the electrospray travel through the capillary 50, desolvation occurs such that ions emerge from an exit 52 of the capillary 50. A mixture a gas and charged particles travels through the first stage of the API interface (e.g., through the vacuum chamber 56) to the first pumping stage, as represented by arrow 62.

The vacuum chamber 56 includes an extraction orifice 54. An ion transfer region 60 is located on a side of the extraction orifice 54 opposite to the vacuum chamber 56 and an extraction lens 58 is provided near the extraction orifice 54 to assist in guiding particles/ions from the vacuum chamber 56 to the ion transfer region 60. Thus, as the mixture of gas and charged particles passes the extraction orifice 54 of the vacuum chamber 56 charged particles will be preferentially pulled into the ion transfer region 60 by an electric field generated by the extraction lens 58. Gas molecules will also be pulled through the extraction orifice 54 by the pressure differential that exists across it (e.g., the transfer region 60 is at a lower pressure than the vacuum chamber 56), but the gas entering the ion transfer region 60 will be significantly enriched in ions compared to the ratio of ions/molecules in first vacuum chamber 56. As explained in more detail herein, as the mixture of gas and ions travels along the flow path in the vacuum chamber 56, the mixture of gas and ions encounters both laminar flow regions and turbulent flow regions with the velocity of the gas being greater in the laminar flow regions than in the turbulent flow regions. The extraction orifice's location is determined and placed such that the extraction orifice is located in region where the gas flow and ions exhibits turbulent flow. The extraction orifice 54 can have a diameter from about 0.25 mm to about 3 mm (e.g., from about 0.25 mm to about 1 mm, from about 1 mm to about 2 mm, from about 2 mm to about 3 mm).

The ion transfer region 60 is typically operated in the RF-only mode and may be composed of a quadrupole, hexapole, octapole or similar ion optics device 28. In embodiments in which a hexapole device is used as the ion transfer region, the ions are constrained within the multipole field while the pressure of gas molecules is further reduced by the second pumping stage 68 to $10^{-2}$ to $10^{-4}$ Torr (e.g., from about $10^{-2}$ to about $10^{-3}$ Torr, from about $2\times10^{-3}$ to about $8\times10^{-3}$ Torr, about $5\times10^{-3}$ Torr). The ions are guided through an aperture 76 into a mass analyzer region 72, in this instance equipped with a quadrupole analyzer 30 to separate the ions by mass to charge ratio and into a detector 32. The detector 32 amplifies the weak ion current signal of the sample based on the mass-to-charge ratio of the ions. The analyzer and detector regions 72 are pumped by a third pumping stage 70 to a pressure of $10^{-4}$ to $10^{-8}$ Torr (e.g., from about $10^{-4}$ to about $10^{-6}$ Torr, about $10^{-5}$ Torr).

As noted above, the system described herein relates to devices wherein charged particles are created at or near atmospheric pressure. Such a charged particle source may comprise an electrospray ion source or an atmospheric pressure chemical ionization source (APCI), or any other source of charged particle generator. Additionally, charged particles may also be generated by Direct Analysis in Real Time (DART), Desorption Electrospray Ionization (DESI), nano electrospray ionization (nanoESI) or from other forms of charged particles generated under similar conditions.

Such ions created at or near atmospheric pressure can be collected when the ions are formed within the close vicinity of a capillary inlet and where a pressure gradient is formed across such a capillary 50 by maintaining a substantially lower pressure on the second side of said capillary. For example, the secondary side of the aperture or capillary may be maintained at a pressure of ~1 Torr by a vacuum pump with a pumping speed of greater than 10 $m^3$/hr. At such a pumping speed the velocity of gas flow down a 1 mm diameter capillary is given by:

$$\text{Pumping speed} = \text{gas flow velocity} \times \text{cross sectional area of pipe} \times \text{local density}$$

As the gas drawn into the capillary 50, (FIG. 1) the gas is transported down the capillary 50 and is expelled at sonic speeds from the end of the capillary 52. At some locations, this process will generate a turbulent flow as the gas enters the capillary 50 at atmospheric pressure. It is believed that the flow becomes laminar at some point toward the low pressure end of the capillary 50, e.g., near the exit 52. For example, the Reynolds number for air moving through a 1 mm diameter tube from atmospheric pressure to ~1 mbar is ~300 at the low pressure end; nearly 10× below the laminar flow limit and so the flow must necessarily, at some point, become laminar. While the diameter of the capillary is likely to be substantially smaller than 1 mm (e.g., 300-500 microns), it is still believed that the difference in pressure will cause the flow to become laminar. However, the region of laminar flow will be characterized by a transition from mean free path<<capillary diameter to the situation where the mean free path ~ capillary diameter. The mean free path is ~100 microns at 1 Torr so the laminar flow region will only exist towards the end of the capillary 52. The pressure drop down the capillary 50 will not, therefore, be linear. The pressure will drop rapidly in the turbulent region until it reaches a few Torr after which the pressure drop will be approximately linear with distance.

The pumping speed of a mechanical first stage pump is independent of pressure over a considerable range of pressures. A pumping speed of 10 $m^3$/hr will give a gas velocity at ~1 Torr which is supersonic. Such a flow along the inside of a smooth capillary 50 will be laminar at the low pressure end (e.g., near exit 52) because the viscous forces will be considerable when compared with the inertial forces.

Figure 2:
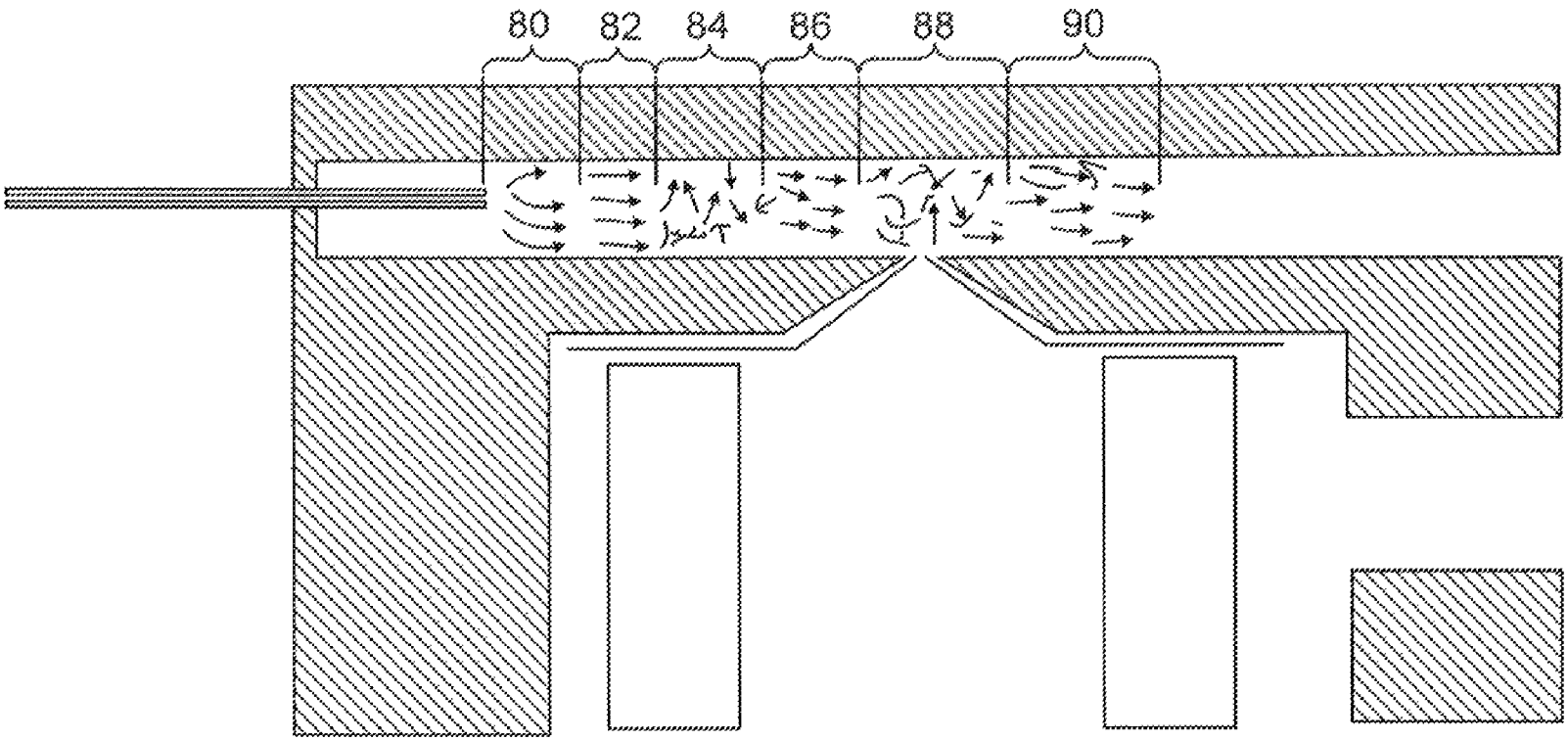
FIG. 2 shows a schematic representation of a mass spectrometry system.

As the gas exits the capillary 50 at the low pressure end 52 there is a discontinuity in the pressure gradient as the local, capillary exit pressure drops suddenly. As the pressure drops the gas molecules are cooled as the initial random velocity distribution is transferred to a uniform directed velocity and the gas temperature drops. The gas exiting the capillary has a supersonic velocity but is suddenly no longer bounded by the inside walls of the capillary. The gas molecules continue at high velocity for several millimeters at the exit of the capillary through a gas expansion zone 64 until they encounter a turbulent region known as the Mach disk 66. In this region the gas is no longer driven by the pressure gradient so the flow stalls and becomes turbulent as the local pressure rises. FIG. 2 shows an exemplary visualization of the gas flow in the vacuum chamber 56 with the gas/ion paths being represented by arrows. As shown in FIG. 2, as the gas exits the capillary 50, there is a first region of gas expansion 80 followed by alternating regions of laminar flow (e.g., regions 82, 86, and 90) and regions of turbulent flow (e.g., regions 84 and 88). An exemplary description of generation of such Mach disks and regions of turbulent flow is described, for example, in John B. Fenn. Mass Spectrometric Implications of high-pressure ion sources, Int J. Mass Spectrom. 200 (2000) 459-478 which is hereby incorporated by reference in its entirety.

Charged particles, present in trace quantities within the gas, are drawn along with the flow of gas. As the pressure drops along the capillary and the charged particles are drawn into the laminar region, two effects occur. First, frequent random collisions with, by now, cold gas molecules reduce the random velocity of the charged particles such that their temperature is reduced. Second, the charged particles of various masses, m, become imprinted with the flow velocity such that they attain a momentum my in the flow direction.

The transport of charged particles in this first stage of an atmospheric pressure ion source is thus intrinsically bound up with the transport of gas molecules. Charged particles may only be present within the transport gas at a concentration of 1 per million to 1 per thousand million ($10^{-9}$) so collecting and analyzing ions directly from the transport gas in region 56 is highly inefficient. In order to increase the efficiency, it can be beneficial to separate the gas flow and the charged particle flow. The system shown in FIG. 1 provides a way to extract charged particles from the gas flow by the use of an electrostatic field 55 such that the gradient of the electrostatic field is principally set across the path of the gas transport. Such an electric field could, for example, be produced by an isolated aperture 54 set in the wall of the secondary chamber in the low pressure (e.g., 1 Torr) region 60. Such an aperture set within the chamber wall and isolated from it could project a field 55 with a differential voltage between the chamber wall and the extraction lens 58.

Charged particles would be drawn toward this aperture 54 by the field 55 and would be attracted or directed into the aperture 54 and beyond into the ion transfer region 60. Such an extraction device separates the charged particle transport from the gas transport thus making possible the creation of a sensitive instrument without a massive pumping system by increasing the ratio of sample ions to gas molecules entering the ion transfer region 60. It is believed that the location of the extraction aperture 54 has a large effect on the functionality of the system as the efficiency will depend on the momentum of the ions passing the aperture 54. In the systems described herein, the extraction aperture 54 is located opposite or nearly opposite (e.g., in the wall of the vacuum chamber 56 at a location corresponding to a location where the gas flow inside the vacuum chamber 56 undergoes turbulent flow) the region wherein the Mach disk or turbulent region is formed (e.g., regions 84 and 88 shown in FIG. 2). In some examples, the extraction aperture is located near the turbulent region but not at a location exactly corresponding to the turbulent region. For example, the extraction aperture can be located just following (e.g., within 10 mm after) the turbulent region.

Figure 3B:
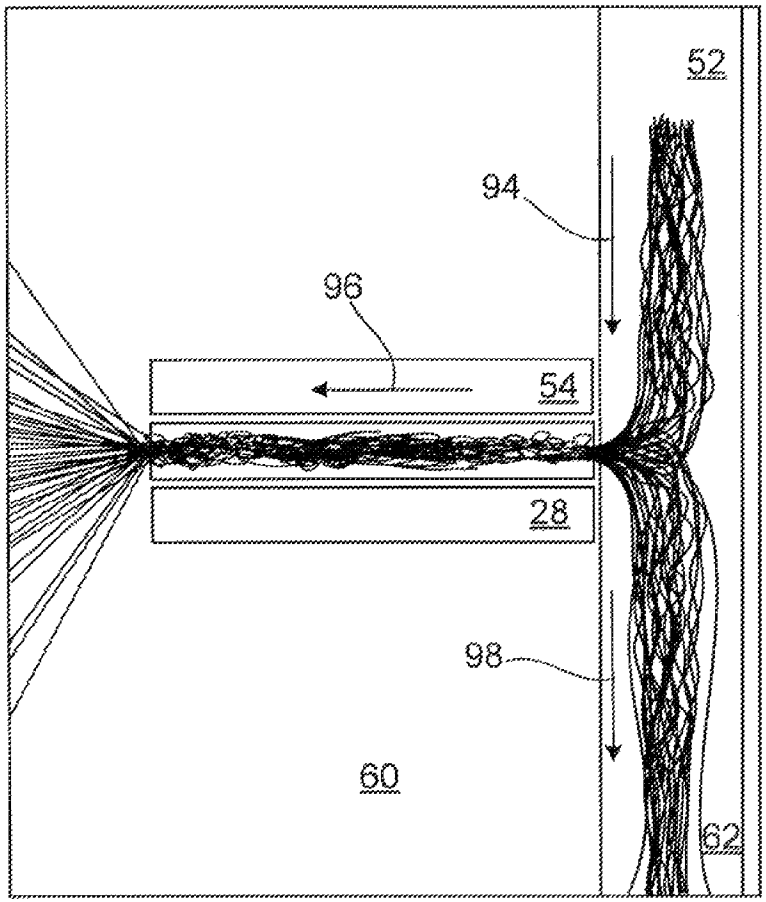
FIGS. 3A and 3B are models showing exemplary extraction of ions.
Figure 3A:
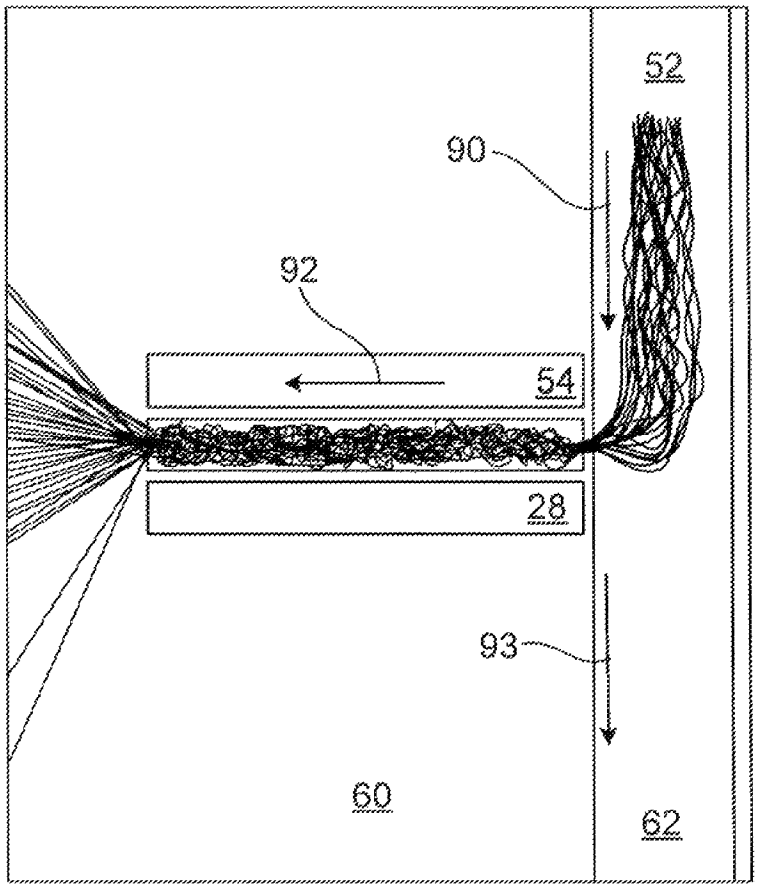

FIGS. 3A and 3B are models of gas transport simulated using SIMION, a software package used to calculate electric fields and the trajectories of charged particles in those fields when given a configuration of electrodes with voltages and particle initial conditions, including optional RF (quasistatic), magnetic field, and collisional effects. The SIMION models of FIGS. 3A and 3B show the extraction of high mass ions (~500 amu) with a velocity of 200 m/s and 600 m/s, respectively. As seen from the models, at the lower velocity the charged particles are collected more efficiently. Thus, it is believed that sampling ions in a region the Mach disk or turbulent region is formed (and the velocity is lower) can provide the advantage of increasing ion collection efficiency.

More particularly, in FIG. 3A ions are modeled that are traveling at a constant 200 m/s through the first vacuum chamber 56 (FIG. 1), as indicated by arrow 90. As the ions travel through the chamber 56 and approach the extraction orifice 54, substantially all of the ions are extracted through the extraction orifice 54 into the ion transfer region 60, as indicated by arrow 92. Only a negligible portion of the ions continue along the chamber 56 toward the first pumping stage 62, as indicated by arrow 93. The extracted ions are shown travelling along the axis of the multipole 28 towards the mass analyzer, as indicated by arrow 92.

FIG. 3B shows the extraction when the velocity of the ions in the first vacuum chamber 56 is increased to 600 m/s whilst maintaining the same electric field as in the simulation of FIG. 3A~*now* more than half the ions miss the extraction orifice 54 and carry on to be lost in the first pumping stage 62. More particularly, at the higher ion velocity, as the ions travel through the chamber 56 and approach the inlet 54 (as indicated by arrow 94), only a portion of the ions are extracted through the inlet 54 into the ion transfer region 60, as indicated by arrow 96. A substantial portion of the ions continue along the chamber 56 toward the first pumping stage 62, as indicated by arrow 98.

In some examples, the aperture to collect the ions can be placed within the 'quiet zone' of the expanding jet near the exit from the capillary 54 (e.g., region 80 in FIG. 2). A disadvantage with this method is that the charged particles have a momentum perpendicular to the extracting field which is proportional to the mass of the charged particle. Large mass molecules such as bio-molecules will have a significant momentum perpendicular to the extracting field and may only be withdrawn with an extracting field which may be inconveniently large. The extraction efficiency will be dependent on mass and the device will exhibit a large mass discrimination effect cutting off performance at high mass. In contrast to placing the aperture in the 'quiet zone' in examples described herein the extracting aperture is located opposite or nearly opposite the region wherein the Mach disk or turbulent region is formed (e.g., in a portion of the wall of chamber 56 at a location where the gas flow exhibits a Mach disk/turbulent flow region). As such, the ions are collected from a region of turbulent flow. In this region the gas flow velocity is significantly reduced compared to the quiet some or laminar flow regions thus making efficient the collection of large mass bio-molecules without the need for excessive extraction fields.

When gas exits from a high pressure into a low pressure region, the gas undergoes many transformations in flow. First, the gas enters the 'quiet zone' just after the exit from the high pressure zone and expansion of the gas to fill a larger volume. In this region, the velocity of the gas can be high. The 'quiet zone' is followed by alternating regions of laminar flow and Mach disks or regions of turbulent flow (e.g., as shown schematically in FIG. 2). The exact location of the Mach disks is determined based on a combination of factors including diameter of the region, pressure, etc.

In gas flow, the Mach disk region (e.g., the region of turbulent flow) is characterized by a significant drop in the gas velocity. This may be as low as 300 m/s, similar to those speeds modeled in FIG. 3B. Thus, it is believed that high extraction efficiency could be achieved at any of those turbulent regions (e.g., in the regions associated with the Mach disks).

The position of the Mach disk for an aperture between a high pressure region at a pressure P0 (in this case the pressure just before the end of the capillary 52) and a low pressure region at pressure P1 (in this case the first vacuum chamber 56) is given by an empirical expression:

$$X_M = \tfrac{2}{3}(P0/P1)^{1/2}$$

where the dimensions of $X_M$ are 'aperture diameters' so that if $X_M=1$ the Mach disk is formed a distance behind the aperture equal to the diameter of the aperture. For example, if P0 is atmospheric pressure (760 Torr) and P1 is 1 Torr then $X_M$ is 18.4 aperture dimensions; 18.4 mm for a 1 mm aperture.

Figure 4A:
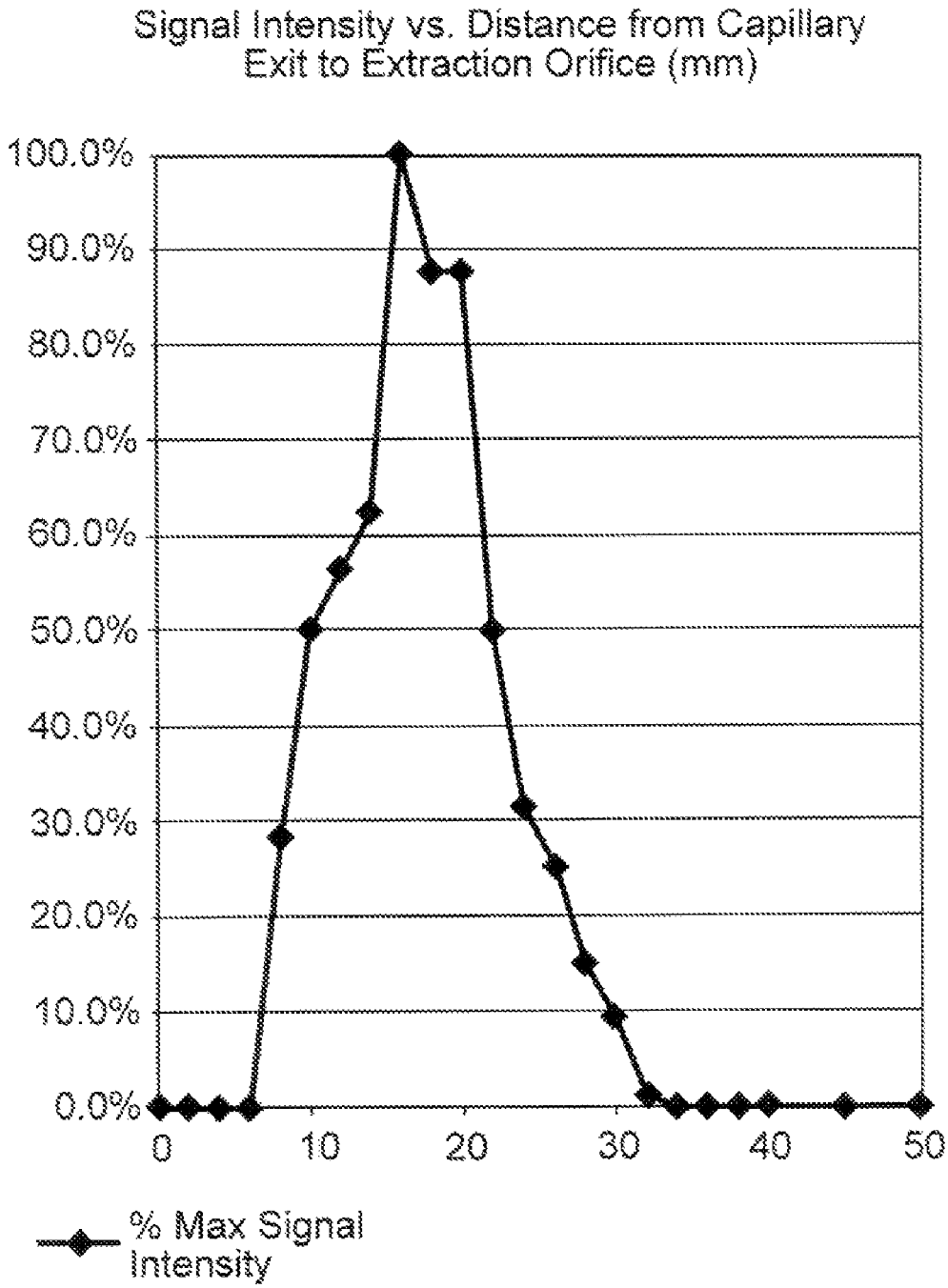
FIG. 4A shows a graph of signal intensity versus distance form capillary exit to extraction orifice.
Figure 4B:
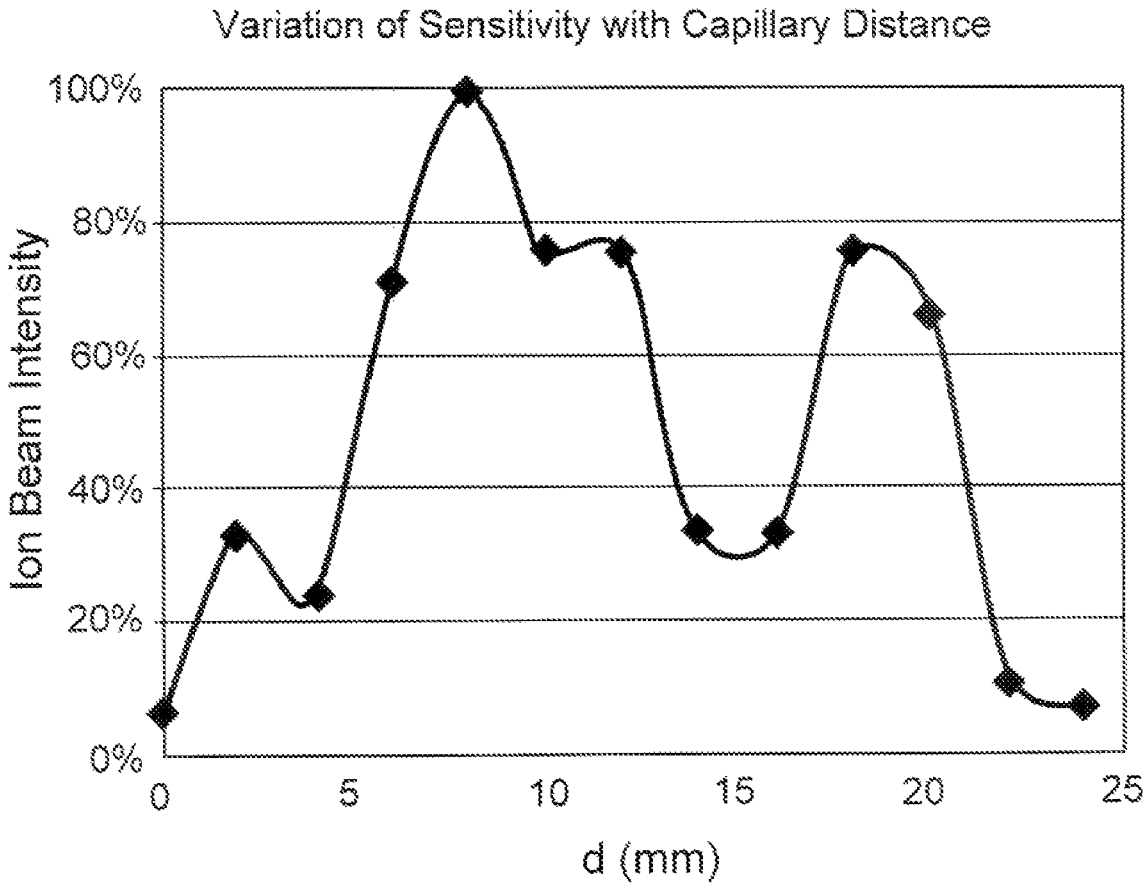
FIG. 4B shows a graph of ion beam intensity versus distance.

Experiments measuring the sensitivity of extraction, e.g., the variation in ion signal (charged particles) as a function of position away from the capillary exit are described in relation to FIG. 4A. As shown in FIG. 4A, these measurements show a single maximum approximately 15 mm away from the capillary exit (52, FIG. 1). Thus, in this example, it is observed that the ion current signal intensity reaches an optimum at approximately 18 mm from the capillary extraction orifice. This result is consistent with extraction from or just behind the Mach disk turbulent region. However, the agreement with the expression above, Equation 1, is not exact. The presence of a large number of molecules rushing away from the capillary at supersonic speeds may have the effect of drawing the Mach disk further away from the capillary than is suggested by the simple, empirical formula. The presence of the extraction aperture will disturb the flow in the chamber which is not accounted for in the model and the means of gas and ion extraction is a mix of electric filed and gas dynamics over a significant volume which will tend to smooth the sharper boundaries expected by the simple model. It is believed that, because the shocks waves are several mean free paths in thickness, the Mach disks are not abrupt discontinuities, but broad, diffuse regions where molecules from the jet gas would interact with the background gas. This is described, for example, in "Mass spectrometric implications of high-pressure ion sources" by John B. Fenn in International Journal of Mass Spectrometry 200 (2000) 459-478. In subsequent experiments, as shown in FIG. 4B, it has been observed that multiple maxima in sensitivity of extraction exist. Thus, it is believed that multiple Mach disks and turbulent regions are formed and that the efficiency of sampling can be increased by placing an extraction aperture near the location of any one of the Mach disks and turbulent regions (e.g., at or near the location of the first Mach disk in the gas flow path, at or near the location of the second Mach disk in the gas flow path, at or near the location of the third Mach disk in the gas flow path, at or near the location of the fourth Mach disk in the gas flow path).

Alternative geometries can be envisioned which would have similar gas dynamics but may further improve the ability to separate charged particles from gas molecules and especially droplets and solid particles. These may have advantages in further reducing contamination and in ease of mechanical arrangement and are depicted in FIGS. 5 through 7.

Figure 5:
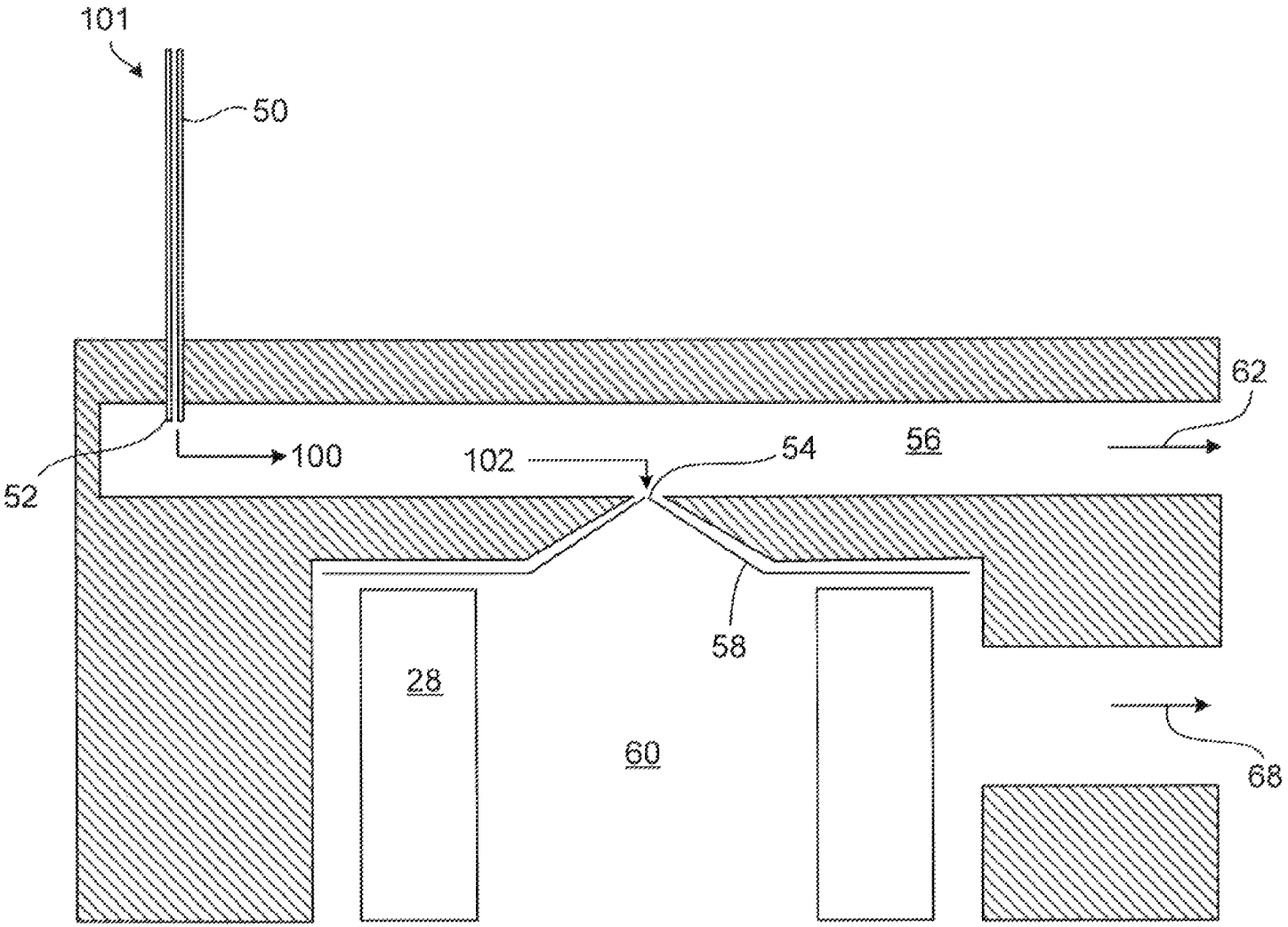
FIG. 5 shows a schematic representation of a mass spectrometry system.

FIG. 5 shows a schematic representation of a mass spectrometry system that is similar to the mass spectrometry system shown in FIG. 1. The system includes a capillary 50 that receives electrospray droplets from a source (not shown). The system directs the ions from the electrospray through the capillary 50 to an outlet of the capillary 52 and into a vacuum chamber 56. Ions are collected from an extraction aperture 54 in the vacuum chamber and transported into an ion transfer region 60. The capillary inlet 101 is oriented in the same direction as the extraction orifice 54 but offset from the extraction orifice so that the gas stream must negotiate two 90° changes in direction (as represented by arrows 100 and 102). This may further help to produce turbulence and reduces the chance for un-desolvated contamination to make it into the transfer region. Thus, the direction of the airflow in the capillary 50 is about 90 degrees from the direction of the airflow in the vacuum chamber 56. Similar to the examples described above, multiple regions of laminar flow and turbulent flow will exist within the vacuum chamber 56. The extraction aperture 54 is located in the region wherein the Mach disk or turbulent region is formed. Thus, the ions are collected from a region of turbulent flow where the velocity of the ions is less than the velocity of the ions in the regions of laminar flow.

Figure 6:
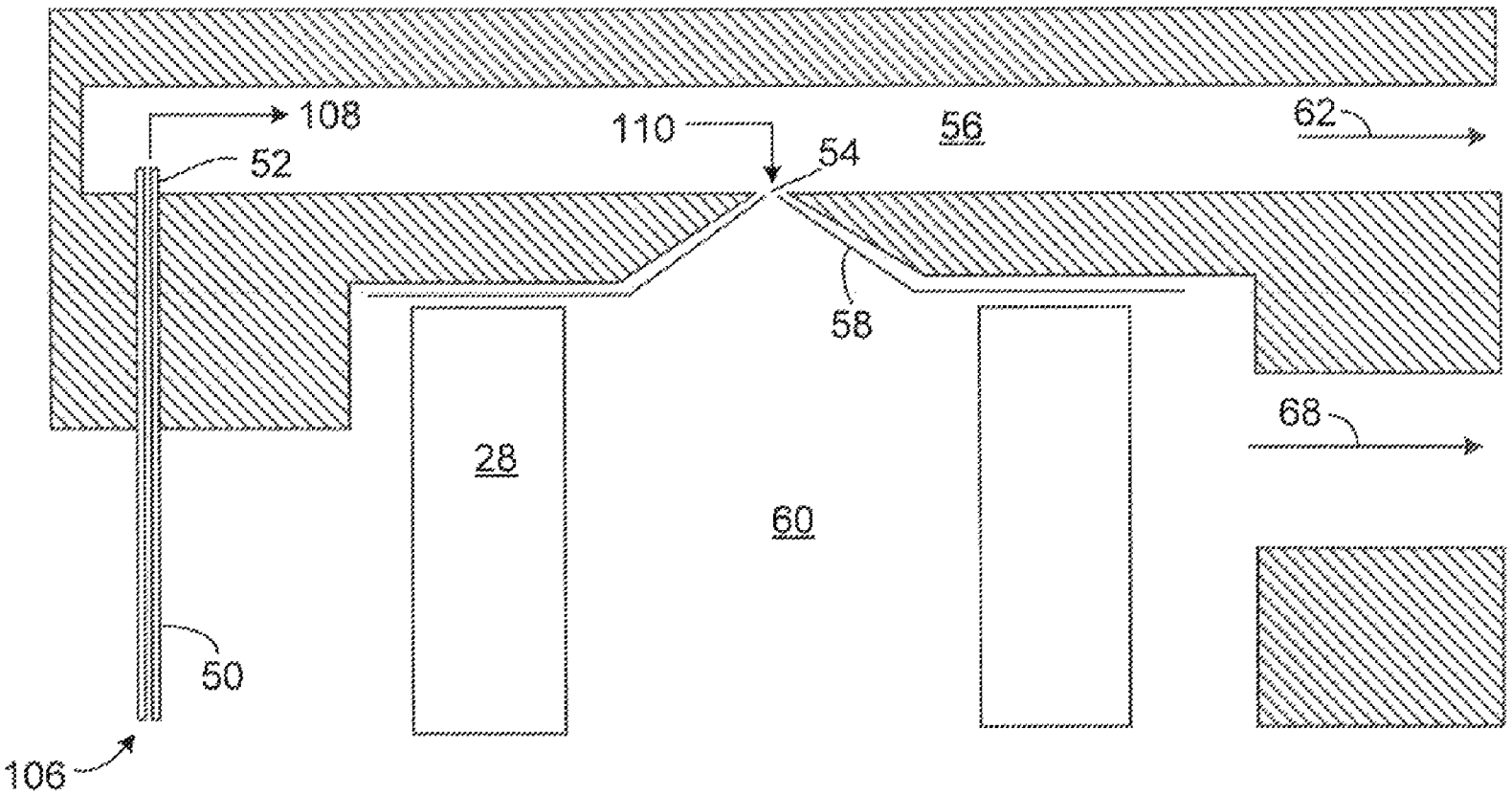
FIG. 6 shows a schematic representation of a mass spectrometry system.

FIG. 6 shows a schematic representation of a mass spectrometry system that is similar to the mass spectrometry system shown in FIG. 1. The system includes a capillary 50 that receives electrospray droplets from a source (not shown). The system directs the ions from the electrospray through the capillary 50 to an outlet of the capillary 52 and into a vacuum chamber 56. Ions are collected from an extraction aperture 54 in the vacuum chamber and transported into an ion transfer region 60. An inlet 106 of the capillary 50 is positioned 180° from the extraction orifice 54 so the gas flow originates from behind the extraction orifice 54. Such an orientation and location of the capillary 50 may reduce the overall size of the instrument. Due to the location of the capillary 50, the gas stream must negotiate two 90° changes in direction (as represented by arrows 108 and 110). This may further help to produce turbulence and reduces the change for un-desolvated contamination to make it into the transfer region 60. Thus, the direction of the airflow in the capillary 50 is about 90 degrees from the direction of the airflow in the vacuum chamber 56. Similar to the examples described above, multiple regions of laminar flow and turbulent flow will exist within the vacuum chamber 56. The extraction aperture 54 is located in the region wherein the Mach disk or turbulent region is formed. Thus, the ions are collected from a region of turbulent flow where the velocity of the ions is less than the velocity of the ions in the regions of laminar flow.

Figure 7:
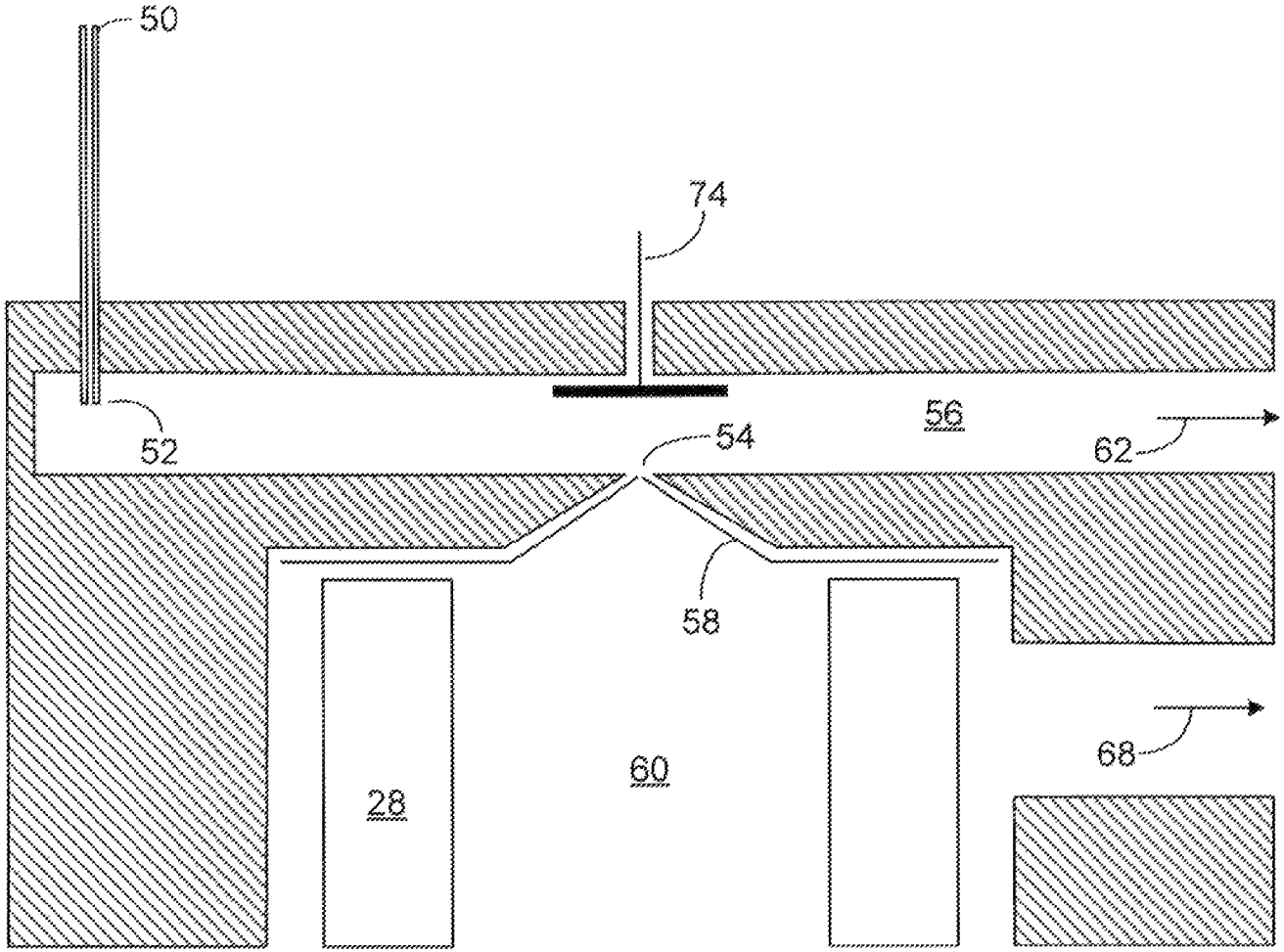
FIG. 7 shows a schematic representation of a mass spectrometry system.

FIG. 7 shows a schematic representation of a mass spectrometry system that is similar to the mass spectrometry system shown in FIG. 6. The system includes a capillary 50 that receives electrospray droplets from a source (not shown). The system directs the ions from the electrospray through the capillary 50 to an outlet of the capillary 52 and into a vacuum chamber 56. Ions are collected from an extraction aperture 54 in the vacuum chamber and transported into an ion transfer region 60. As described in relation to FIG. 6, the extraction aperture 54 is located in the region wherein the Mach disk or turbulent region is formed. Thus, the ions are collected from a region of turbulent flow where the velocity of the ions is less than the velocity of the ions in the regions of laminar flow. Additionally, in the example of FIG. 7, an electric field that extracts the ions into the transfer region is enhanced by a voltage on a pusher electrode 200 opposite the extraction orifice, instead of or in addition to a voltage on the extraction lens; where the pusher electrode augments the field created by the extraction lens. While the pusher electrode is shown in an arrangement in which the capillary is oriented in the same direction as the extraction orifice 54 but offset from the extraction orifice. The addition of the pusher electrode can be used with any orientation of capillary with respect to the extraction orifice.

Other embodiments are in the claims.

What is claimed is:

1. An atmospheric pressure ion source for providing ions to a mass spectrometer system comprising:

a capillary having a first opening, a second opening, and passage extending from the first opening to the second opening, the first opening being in a first pressure region at about atmospheric pressure and the second opening being in the second pressure region at a partial vacuum of about 3 Torr or less, the capillary being positioned so that during operation of the mass spectrometry system ions enter the passage via the first opening and exit the passage via the second opening;

a vacuum chamber defining the second pressure region and having an inlet configured to receive ions from the second opening of the capillary, the vacuum chamber including an extracting aperture positioned so that during operation of the mass spectrometry system ions enter a third pressure region at about $10^{-2}$ Torr or less via the extracting aperture at a location of a turbulent region in the gas flow:

wherein the vacuum chamber is configured such that during operation of the mass spectrometry system alternating regions of laminar flow and turbulent flow are produced in the gas flow.

2. The atmospheric pressure ion source of claim 1, wherein the turbulent region comprises a region exhibiting a Mach disk in the gas flow.

3. The atmospheric pressure ion source of claim 1, wherein the extraction orifice is located at a location determined based at least in part on a calculation of $\frac{2}{3}(P0/P1)^{1/2}$ where P0 and P1 are the pressures of the first and second pressure regions respectively.

4. The atmospheric pressure ion source of claim 1, wherein the extracting aperture is at a location subsequent to a quiet zone in the gas flow in the vacuum chamber.

5. The atmospheric pressure ion source of claim 1, wherein the extracting aperture is at a location subsequent to a quiet zone and at least one region of laminar flow in the gas flow in the vacuum chamber.

6. The atmospheric pressure ion source of claim 1, wherein the extracting aperture is at a location associated a first region of turbulent flow and subsequent to a quiet zone and at least one region of laminar flow.

7. The atmospheric pressure ion source of claim 1, wherein the capillary has a diameter less than about 1 mm and length greater than 5 cm.

8. The atmospheric pressure ion source of claim 1, further comprising a voltage source connected to the aperture configured to produce a substantially orthogonal extracting field perpendicular to the gas flow in the second pressure region.

9. The atmospheric pressure ion source of claim 1, wherein the capillary has A diameter of from about 300 μm to about 1000 μm and the vacuum chamber has a diameter of from about 5 mm to about 20 mm.

10. The atmospheric pressure ion source of claim 5, wherein the capillary has a diameter of from about 50 μm to about 300 μm and the vacuum chamber has a diameter of from about 2 mm to about 10 mm.

11. The atmospheric pressure ion source of claim 5, wherein the capillary has a diameter of from about 700 μm to about 2000 μm and the vacuum chamber has a diameter of from about 15 mm to about 50 mm.

12. The atmospheric pressure ion source of claim 1, further comprising a quadrupole mass analyzer positioned in the third vacuum region.

13. The atmospheric pressure ion source of claim 1, wherein the capillary is configured to form a region of laminar flow near the second opening of the capillary.

14. The atmospheric pressure ion source of claim 1, further comprising a pump configured to form the partial vacuum in the second pressure region and the vacuum in the third pressure region.

15. The atmospheric pressure ion source of claim 1, wherein the first opening of the capillary is oriented in a direction that is 90 degrees from a direction of the extraction orifice.

16. The atmospheric pressure ion source of claim 1, wherein the first opening of the capillary is oriented in a direction that is the same as the direction of the extraction orifice but offset from the extraction orifice.

17. The atmospheric pressure ion source of claim 1, further comprising an electrospray ion source configured to produce an electrospray near the first opening of the capillary.

18. The atmospheric pressure ion source of claim 1, wherein the capillary is a heated capillary.

19. The atmospheric pressure ion source of claim 1, further comprising a pusher plate opposite the extraction aperture in the vacuum chamber.

20. An atmospheric pressure ion source for providing ions to a mass spectrometer system comprising:

a capillary having a first opening, a second opening, and passage extending from the first opening to the second opening, the first opening being in a first pressure region at about atmospheric pressure and the second opening being in the second pressure region at a partial vacuum of about 3 Torr or less, the capillary being positioned so that during operation of the mass spectrometry system ions enter the passage via the first opening and exit the passage via the second opening;

a vacuum chamber defining the second pressure region and having an inlet configured to receive ions from the second opening of the capillary, the vacuum chamber including an extracting aperture positioned so that during operation of the mass spectrometry system ions enter a third pressure region at about 10-2 Torr or less via the extracting aperture at a location of a turbulent region in the gas flow;

wherein the vacuum chamber is configured such that during operation of the mass spectrometry system alternating regions of laminar flow and turbulent flow are produced in the gas flow and the extracting aperture is at a location associated a first region of turbulent flow.

21. An atmospheric pressure ion source for providing ions to a mass spectrometer system comprising:

a capillary having a first opening, a second opening, and passage extending from the first opening to the second opening, the first opening being in a first pressure region at about atmospheric pressure and the second opening being in the second pressure region at a partial vacuum of about 3 Torr or less, the capillary being positioned so that during operation of the mass spectrometry system ions enter the passage via the first opening and exit the passage via the second opening;

a voltage source connected to the aperture configured to produce a substantially orthogonal extracting field perpendicular to the gas flow in the second pressure region;

a vacuum chamber defining the second pressure region and having an inlet configured to receive ions from the second opening of the capillary, the vacuum chamber including an extracting aperture positioned so that during operation of the mass spectrometry system ions enter a third pressure region at about 10-2 Torr or less via the extracting aperture at a location of a turbulent region in the gas flow;

wherein the vacuum chamber is configured such that during operation of the mass spectrometry system alternating regions of laminar flow and turbulent flow are produced in the gas flow, the turbulent region comprising a region exhibiting a Mach disk in the gas flow;

wherein the capillary has a diameter of from about 300 μm to about 1000 μm and the vacuum chamber has a diameter of from about 5 mm to about 20 mm; and wherein the capillary is a heated capillary.

* * * * *